United States Patent [19]

Foederer

[11] 4,174,877

[45] Nov. 20, 1979

[54] CONNECTOR FOR FLAT CABLE

[76] Inventor: Wilhelmus T. Foederer, Henkelbrits 40, Best, Netherlands

[21] Appl. No.: 861,974

[22] Filed: Dec. 19, 1977

[51] Int. Cl.[2] ..... H01R 11/20

[52] U.S. Cl. ..... 339/97 P; 339/217 S; 339/258

[58] Field of Search ..... 339/97 R, 97 P, 98, 339/99 R, 176 MF, 258 R, 258 C, 258 P, 217 S

[56] References Cited

U.S. PATENT DOCUMENTS

| | | | |
|---|---|---|---|
| 2,376,625 | 5/1945 | Schmitt | 339/258 P |
| 4,010,996 | 3/1977 | Hopkins | 339/258 R |
| 4,043,628 | 11/1978 | Narozny | 339/99 R |

OTHER PUBLICATIONS

Ansley publication; Jul. 1974.

*Primary Examiner*—Gerald A. Dost

[57] ABSTRACT

A connector with a dielectric casing that accommodates plural terminals. The terminals have insulation-piercing and pin-receiving contacts for establishing interconnections between a flat cable and plural conductive pins on a circuit element.

1 Claim, 4 Drawing Figures

CONNECTOR FOR FLAT CABLE

BACKGROUND OF THE INVENTION

This invention relates generally to electrical interconnections between circuit elements and, more particularly, to a connector with terminals having both insulation-piercing and pin-receiving contacts.

Terminals with insulation-piercing contacts are, of course, well known. Such a terminal is shown, for example, in FIG. 10 of U.S. Pat. No. 3,820,058 to Friend. The terminal disclosed by Friend also has spaced arms that are well adapted to receive individual leads but have not been found adequate for use with fixed, conductive pins.

SUMMARY OF THE INVENTION

The electrical connector disclosed and claimed herein includes a dielectric casing having plural cavities, an integral guide block in each cavity and a transverse slot for a flat cable. There is also a conductive terminal in each cavity. Each terminal has an elongated mounting portion in the shape of a channel with side walls projecting from a center strip. The guide block has spaced rails for the side walls of the mounting portion and there is a pin-receiving passage between the rails. Bifurcated, insulation-piercing contacts project from the side walls at one end of the mounting portion and the center strip has an extension bent across the mounting portion at its other end. The extended length of the center strip is slotted and has a pin-receiving hole formed as an enlargement of the slot.

In a particularly efficient embodiment, the contact hole of each terminal is formed by punching over the slot in the rear end of the center strip to present flanged lips at the edges of the hole. Thus, an enlarged contact surface is provided in the most efficient and therefore least expensive way, which contact surface also better fixes the insertion direction of the contact pins.

DESCRIPTION OF THE DRAWING

The invention will be explained hereinafter with reference to the drawing in which.

DESCRIPTION OF PREFERRED EMBODIMENT

Figure 2:
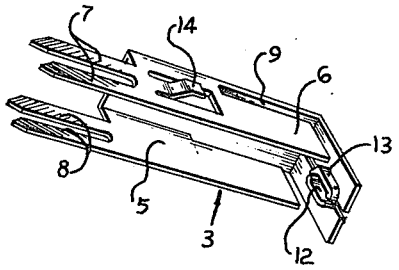
FIG. 2 is another perspective view of the terminal shown in FIG. 1.

The connector chosen for illustration has a casing 1 of insulating material which is provided internally with plural cavities 2. Cavities 2 are adapted to receive terminals 3. Casing 1 is molded from a synthetic resin such as nylon and terminals 3 are stamped and formed from a strip of conductive metal.

Each terminal 3 has an elongated mounting portion in the form of a channel defined by a center strip 4 and laterally bent sides 5,6. At one end of the mounting portion, integral tines or cutting teeth 7,8 project from sides 6,5 and form bifurcated, insulation-piercing contacts.

At the other end of the mounting portion, slots 9 are provided between sides 5,6 and center strip 4. Additionally, strip 4 extends beyond sides 5,6 and the extended length 10 is bent across the mounting portion and closes the end of the channel. Length 10 and strip 4 are provided with a slot 11 that is parallel to the slots 9. Length 10 also has a hole 12 formed by punching over slot 11. The excess material is formed into flanges or lips 13 which not only enlarge the contact surface for a conductive pin but also fix the insertion direction of such a pin. The slots 9 in the sides and the slot 11 in the extended length 10 present two resilient fingers that clamp a pin inserted in the hole 12.

Figure 1:
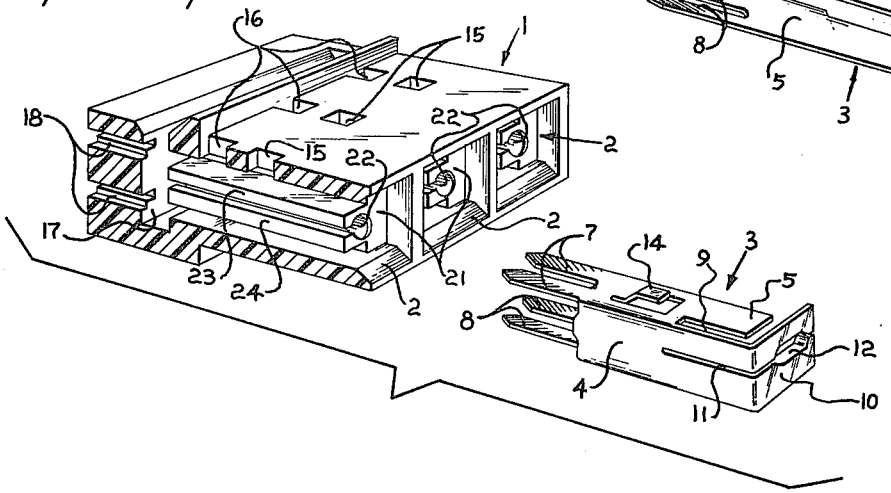
FIG. 1 is a perspective view of a connector according to the invention, including a casing and one conductive terminal.

The side 5 shown at the top of FIG. 1 has a resilient latch 14 with which the terminals 3 can be locked in cavities 2. For this purpose, the upper wall of the casing 1 has two snap-in holes 15,16 above each cavity 2.

At the front side of the contact casing 1, there is a transverse slot 17 adapted to receive a flat cable 19 having spaced, insulated, conductive cores 20. Beyond slot 17, casing 1 is provided with apertures 18 that receive tines 7,8 when a cable has been pierced.

Referring to FIG. 1, there is an integrally molded guide block on a side wall of each cavity 2. Block 21 has a central, pin-receiving passage 22 between spaced rails 23,24.

Figure 3:
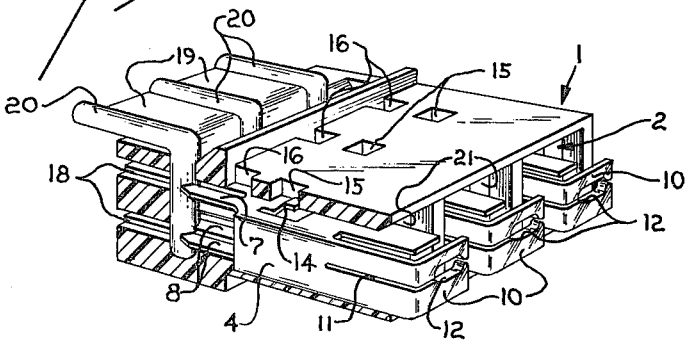
FIG. 3 is a perspective view of the connector showing the terminals latched in a first position to receive a flat cable.
Figure 4:
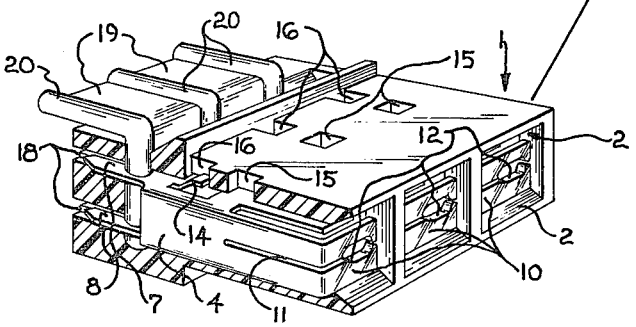
FIG. 4 shows the terminals latched in their contact position.

A connector is pre-assembled by inserting terminals 3 in cavities 2 and sliding sides 5,6 of the mounting portions on tracks 23,24 until latches 14 snap into the holes 15 in the upper wall of the casing (FIG. 3). The tines 7 and 8 are then just outside the cable-receiving slot 17. Next, one end of a flat cable 19 is inserted in the receiving slot. Then, the terminals are pushed through the cavities 2 until their locking latches 14 snap into the holes 16 (FIG. 4). As the terminals are inserted, the tines 7,8 penetrate cable 19, pierce the insulation on cores 20 and enter apertures 18. In this manner, reliable contact is established with each core in cable 19 and contact holes 12 for pins are presented at the rear side of the connector. Each hole 12 and the corresponding passage 22 in a guide block 21 cooperate to fix the position of a pin and thereby insure a reliable electrical connection.

What is claimed as new and desired to be secured by Letters Patent is:

1. A connector comprising a dielectric casing having plural cavities and a conductive terminal in each cavity, said casing having an integral guide block disposed longitudinally in each cavity, said guide block comprised of spaced rails having a pin-receiving passage therebetween, said casing further having a transverse slot for a flat cable, each terminal having an elongated mounting portion in the shape of a channel with side walls and a center strip, tines projecting from said side walls at one end of the mounting portion, said side walls being slidable on said rails, said center strip having a length extending beyond and bent across the mounting portion at its other end, said length having a longitudinal slot and a pin-receiving hole formed as an enlargement of the slot.

* * * * *